US011999544B2

(12) United States Patent
Uyeda

(10) Patent No.: US 11,999,544 B2
(45) Date of Patent: Jun. 4, 2024

(54) PACKAGING WITH INTERLOCKING RIPCORD MECHANICAL LOCK

(71) Applicant: Apple Inc., Cupertino, CA (US)

(72) Inventor: Mark T. Uyeda, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/849,108

(22) Filed: Jun. 24, 2022

(65) Prior Publication Data

US 2023/0415968 A1 Dec. 28, 2023

(51) Int. Cl.
*B65D 55/06* (2006.01)
*B65D 5/64* (2006.01)
*B65D 5/68* (2006.01)

(52) U.S. Cl.
CPC ..... *B65D 55/06* (2013.01); *B65D 5/643* (2013.01); *B65D 2255/00* (2013.01); *B65D 2401/05* (2020.05)

(58) Field of Classification Search
CPC ..... B65D 17/00; B65D 2255/00; B65D 2401/05; B65D 41/32; B65D 5/4283; B65D 5/64; B65D 5/643; B65D 55/02; B65D 55/06; B65D 55/0818; B65D 90/22; B65D 90/12; B65D 90/06; B65D 90/023; B65D 90/0006; B65D 90/00; B65D 85/68; B65D 85/48; B65D 85/42; B65D 85/30; B65D 81/365; B65D 81/3453; B65D 81/3446; B65D 81/261; B65D 81/133; B65D 81/1275; B65D 81/127; B65D 81/113; B65D 81/107; B65D 81/058; B65D 81/054; B65D 81/053; B65D 81/05;
(Continued)

(56) References Cited

U.S. PATENT DOCUMENTS 3,967,774 A 7/1976 Querner
4,871,345 A 10/1989 Wosaba et al.
(Continued)

FOREIGN PATENT DOCUMENTS

JP 2011255958 A * 12/2011 ..... B65D 21/02
JP 2011255958 A * 12/2011 ..... B65D 21/02
(Continued)

OTHER PUBLICATIONS

International Search Report for PCT/US2023/021646, dated Sep. 18, 2023, 5 pages.

*Primary Examiner* — Anthony D Stashick
*Assistant Examiner* — Marcos Javier Rodriguez Molina
(74) *Attorney, Agent, or Firm* — Sterne, Kessler, Goldstein & Fox P.L.L.C.

(57) ABSTRACT

Packaging with a locking mechanism is provided, such as for finished goods packaging, such that a lid and base box may be secured together in a closed configuration. An interlocking ripcord mechanical lock may include a slot and tab style ripcord that is integrated into the packaging. As an example, packaging using corrugated material may utilize the corrugated material thickness to lock the tab record inside an opening such as a slot, such that the base box is retained and coupled to the lid, thereby preventing the base box from sliding out from the lid if a user except packaging by the lid. Once the ripcord is removed, is removed, the mechanical lock is thereby released from the base and lid, allowing the customer to open the packaging.

20 Claims, 8 Drawing Sheets

(58) Field of Classification Search
CPC .... B65D 81/025; B65D 81/022; B65D 81/00; B65D 77/003; B65D 75/527; B65D 75/32; B65D 71/70; B65D 71/08; B65D 65/46; B65D 65/403; B65D 65/38; B65D 5/6673; B65D 5/6611; B65D 5/54; B65D 5/509; B65D 5/5088; B65D 5/505; B65D 5/5035; B65D 5/445; B65D 5/4266; B65D 5/4204; B65D 5/42; B65D 5/326; B65D 5/321; B65D 5/32; B65D 5/067; B65D 5/064; B65D 5/029; B65D 5/0209; B65D 5/02; B65D 3/08; B65D 2585/6855; B65D 2585/6847; B65D 2585/6837; B65D 2585/6835; B65D 2585/6817; B65D 2585/6812; B65D 2581/3489; B65D 2581/3472; B65D 2581/3462; B65D 2581/3441; B65D 2581/058; B65D 2581/055; B65D 2581/053; B65D 25/205; B65D 25/20; B65D 25/107; B65D 25/102; B65D 25/10; B65D 25/06; B65D 25/02; B65D 2301/00; B65D 2251/1016; B65D 2251/1008; B65D 2203/10; B65D 2201/00; B65D 17/462; B65D 1/34; B65D 1/26; B65G 7/12; B65G 69/001; B65G 67/603; B65G 67/60; B65G 67/24; B65G 65/00; B65G 63/004; B65G 47/54; B65G 47/53; B65G 47/52; B65G 43/08; B65G 37/02; B65G 2814/0397; B65G 2812/02138; B65G 2812/02118; B65G 23/02; B65G 23/00; B65G 2203/0216; B65G 2201/0235; B65G 2201/02; B65G 15/30; B65G 1/1375; B65G 1/1373; B65G 1/1371; B65G 1/137; B65G 1/10; B65G 1/0407; B65B 9/10; B65B 7/20; B65B 63/005; B65B 61/26; B65B 61/207; B65B 61/06; B65B 61/025; B65B 61/007; B65B 59/003; B65B 57/02; B65B 53/02; B65B 51/142; B65B 51/05; B65B 5/08; B65B 43/52; B65B 43/46; B65B 43/285; B65B 43/265; B65B 35/56; B65B 35/24; B65B 3/022; B65B 25/02; B65B 23/20; B65B 2230/02; B65B 11/48; B65B 1/10
USPC .... 206/0.82, 1.5, 216, 219, 459.5, 461, 469, 206/484, 524.3, 807, 820, 824, 830, 37, 206/45.23, 320, 454, 522, 523, 524, 584, 206/591, 711; 220/23.4, 23.8, 62.12, 220/62.17, 62.22, 235, 254.1, 257.1, 220/257.2, 258.1, 263, 265, 266, 269, 220/270, 274, 277, 278, 279, 280, 318, 220/319, 359.1, 359.2, 375, 495.03, 553, 220/619, 626, 667, 677, 737, 755, 756, 220/763, 789, 791, 832, 890, 906, 220/DIG. 11, DIG. 30, 2.1 A, 2.1 R, 220/592.02, 62.2, 660; 229/4.5, 5.5, 5.6, 229/5.7, 5.84, 100, 102, 103, 109, 119, 229/120.011, 120.32, 123.1, 125.15, 229/125.18, 125.35, 125.38, 186, 198.2, 229/201, 203, 211, 235, 237, 239, 245, 229/248, 406, 926, 927, 116.1, 137, 920; 428/343, 355 AC
See application file for complete search history.

(56) References Cited

U.S. PATENT DOCUMENTS

| | | | | |
|---|---|---|---|---|
| 7,588,148 | B2 * | 9/2009 | Yang | B65D 5/509 206/592 |
| 2019/0225365 | A1 * | 7/2019 | Couture | B65D 5/328 |

FOREIGN PATENT DOCUMENTS

| | | |
|---|---|---|
| WO | 1996013441 A1 | 5/1996 |
| WO | 2012130528 | 10/2012 |

* cited by examiner

PACKAGING WITH INTERLOCKING RIPCORD MECHANICAL LOCK

FIELD

The described embodiments relate generally to retail packaging. More particularly, the present embodiments relate to folded panel packaging using an interlocking ripcord mechanical lock for security. The ripcord may include a corrugated material that when assembled interferes with a cut-out or slot in a lid of the packaging, such that the lid is mechanically locked to a base box prior to opening the packaging.

BACKGROUND

Product packaging is an integral part of a customer's experience. It introduces the customer to their product, and can affect the customer's feelings toward the product and the company that created it. Packaging that is simple, clean, and secure may help influence the customer's impression of the product packaged within. At the same time, intuitive securing elements strike a balance between securing the package in a closed state prior to purchase, for example, with the ease with which a customer may access their product within the packaging once a sale is complete.

Structural and environmental considerations may also play a role in designing packaging. For example, packaging may be designed to be environmentally friendly—while retaining sufficient structure to ensure robust protection for the products contained within it. Many ripcords used in finished goods packaging are a thin film of plastic, either in a strip or a full packaging enclosure, or are a label that is adhered to the outside of the packaging to seal the packaging closed. For larger packaging, and for packaging that would benefit from an interesting customer experience, a ripcord type mechanical locking mechanism that leverages the intuitive nature of ripcords, while providing a mechanical lock, is advantageous. Packaging described in this document achieves these and other beneficial characteristics by balancing structural robustness, eco-friendly materials, secure closure mechanisms with intuitive user experiences, and aesthetic elements.

SUMMARY

Some embodiments include packaging including a base box, a lid, and a ripcord configured to mechanically lock the base box and the lid such that the base box and the lid are secured together in a closed configuration. In some embodiments, the ripcord is not fixed to the lid. In some embodiments, when the ripcord is pulled with sufficient force, it is removable such that the mechanical lock is released so that the packaging may be opened.

In some embodiments, the base box includes a substrate that the ripcord is fixed to, such that the substrate tears when the ripcord is pulled with sufficient force, thereby releasing the mechanical lock. In some embodiments, the substrate includes a wrap panel that covers a cardboard corrugate panel of the base box. In some embodiments, the substrate is configured to tear along tear paths extending along the direction of the pull force.

Some embodiments include packaging, including a base box including a first side panel. In some embodiments, the packaging includes a lid including a first side panel parallel to, and external to, the base box's first side panel, and a slot formed in the lid's first side panel. In some embodiments, the packaging includes a ripcord disposed within the slot and fixed to the base box when the packaging is in a closed configuration, such that the base box and lid are secured together in a closed configuration.

In some embodiments, the lid includes cardboard corrugate having a thickness, and the ripcord includes cardboard corrugate having a thickness, such that the respective edges of the slot and the edges of the ripcord interfere with each other, thereby retaining the lid in place relative to the base box until the ripcord is removed from the packaging. In some embodiments, the ripcord is attached to a substrate formed on the base box's first side panel such that in response to a sufficient force applied along a tearing direction of the ripcord, the substrate tears away from the base box but remains fixed to the ripcord, thereby releasing the lid and base box.

In some embodiments, the ripcord is attached to the base box via a splittable adhesive, such that in response to a sufficient force applied along a removal direction of the ripcord, the splittable adhesive splits such that the ripcord is removed, thereby releasing the lid and base box.

In some embodiments, the substrate is part of a wrap panel and is not fixed to the base box's first side panel.

In some embodiments, the ripcord further includes a tab configured to allow a user to grasp the ripcord, and the substrate terminates in a tab that connects to the tab of the ripcord, and is accessible via a cutout along the base box's first side panel. In some embodiments, the ripcord does not include plastic. In some embodiments, a length of the slot is longer than a length of the ripcord, along a removal direction of the ripcord. In some embodiments, the ripcord extends between 50% and 85% of the length of the base box's first side panel, along a removal direction of the ripcord.

Some embodiments include packaging, including a base box including a first side panel including a first material, a first wrap panel covering an outwardly facing surface of the first panel and including a second material, a lid including a first side panel parallel to, and external to, the base box's first side panel, and including the first material, and a first wrap panel covering an outwardly facing surface of the first panel and including the second material. In some embodiments, a slot is disposed in the lid's first side panel and first wrap panel, and a ripcord is disposed within the slot and fixed to the base box's first wrap panel when the packaging is in a closed configuration, such that the base box and lid are secured together via a mechanical lock formed from the ripcord and slot, together, in a closed configuration.

In some embodiments, when the ripcord is pulled with sufficient force, a portion of the base box's first wrap panel tears away with the ripcord, thereby allowing the ripcord to be removed from the slot, and releasing the mechanical lock. In some embodiments, the packaging includes a secondary panel including the second material and disposed beneath the base box's first wrap panel, such that when the ripcord is removed, the first material is not visible to a user.

In some embodiments, the first material is cardboard corrugate, and the second material is not cardboard corrugate.

In some embodiments, the first material has a thickness, and the ripcord comprises the first material, such that the thickness of the slot and the thickness of the ripcord interfere with each other, thereby forming the interlocking mechanical lock until the ripcord is removed from the packaging. In some embodiments, the ripcord further includes ripcord wrap panels comprising the second material, and the first material is cardboard corrugate, and the second material is not cardboard corrugate.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
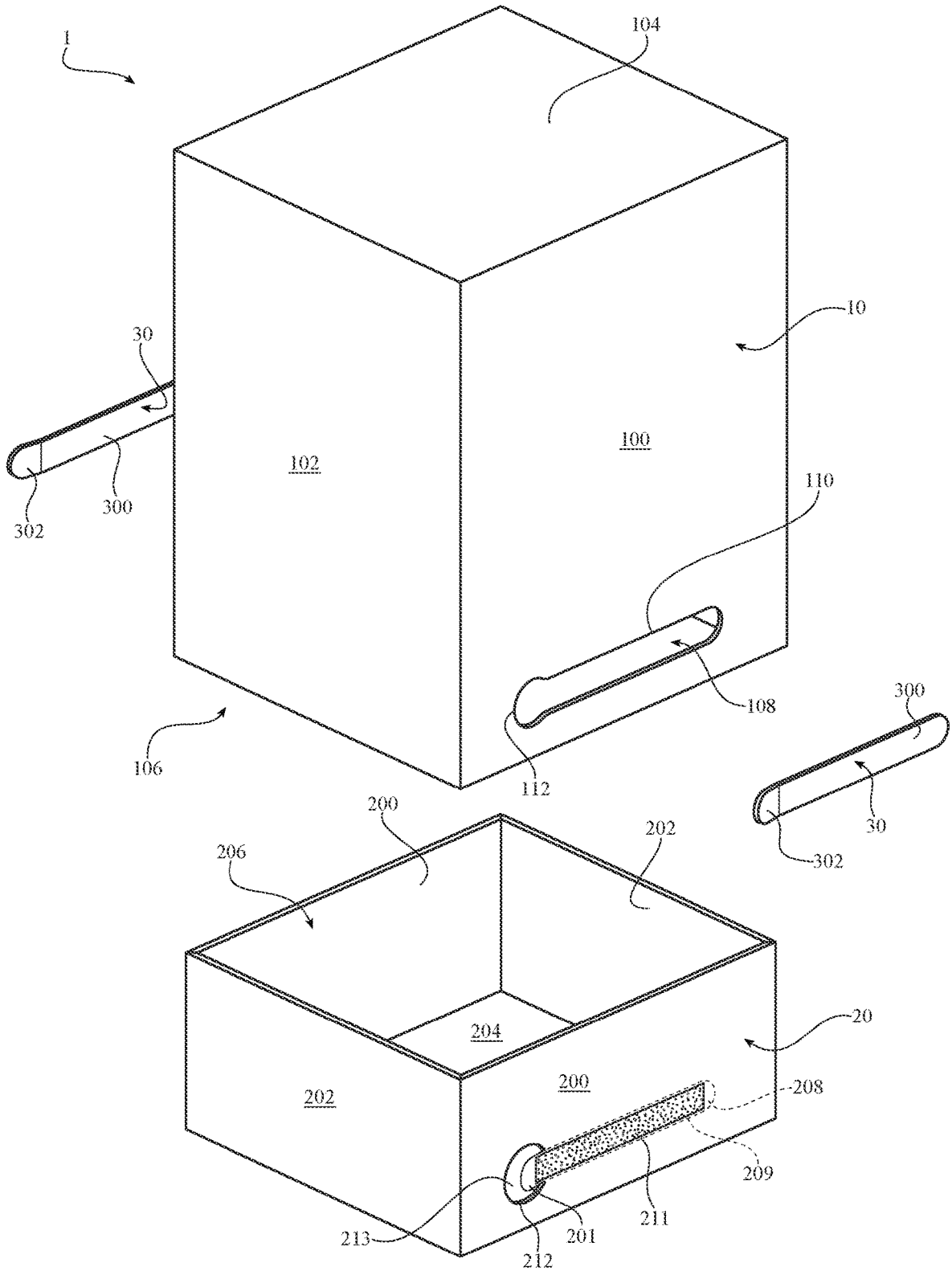
FIG. 1 shows an exploded view of packaging having an interlocking ripcord mechanical lock, according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As described above, many ripcords used in finished goods packaging are a thin film of plastic, or a label that is adhered to the outside of the packaging, thus sealing the packaging closed. As described herein, packaging with interlocking ripcord mechanical locks provide interesting and secure alternative to such closure elements as thin-film ripcords. A locking mechanism is provided, such as for finished goods packaging, such that a lid and base box may be secured together in a closed configuration.

The interlocking ripcord mechanical lock may include a slot and tab style ripcord that it integrated into the packaging. As an example, packaging using corrugated material may utilize the corrugated material thickness and contacting edges to lock the ripcord inside an opening such as a slot, such that the base box is retained and coupled to the lid, thereby preventing the base box from sliding out from the lid if a user lifts the packaging by the lid. In some embodiments, the corrugated material (and thus the panels of the lid, base box, and ripcord) is at least 1.0 mm thick. In some embodiments, the corrugated material (and thus the panels of the lid, base box, and ripcord) is about 1.5 mm thick. In some embodiments, the corrugated material (and thus the panels of the lid, base box, and ripcord) is greater than 1.5 mm thick.

Once the ripcord is removed, the mechanical lock is thereby released from the base and lid, allowing the customer to open the packaging. These features also provide a packaging solution utilizing environmentally friendly materials while allowing for a ripcord functioning as a tamper-evident seal to provide added assurance to a customer or a retailer that the packaging has not been opened or tampered with (e.g., there has been an "unauthorized" opening of a package prior to the intended opening).

The packaging may be retail packaging (i.e., finished packaging for containing and conveying a product to a user such as may be used in a retail setting, not shipping packaging providing outer packaging for containing a packaged product during shipment) that one may expect to find on the shelf in a retail store, and which one may open after purchase to directly access their product. The packaging may be made out of recyclable and/or biodegradable materials, such as paper, cardboard, greyboard, cardboard corrugate (e.g., E-flute or F-flute), or other cellulose-based products that can reduce environmental impact, especially when it is intuitive for a customer to properly recycle the packaging and it may be recycled in a single-stream system. In some embodiments, outwardly facing surfaces of the packaging may be covered in a wrap of panels of a finished cellulose-based product (e.g., paperboard such as solid bleached sulfate "SBS"), while the structure of the packaging may be provided by a different material, such as cardboard corrugate for added thickness and strength.

A product contained by the packaging may be, for example, an electronic device such as, for example, headphones, a laptop, tablet computer, or smartphone, or it may be a non-electronic device, such as, for example, a book. In any case, the packaging may contain additional elements housing the product (e.g., headphones within a case).

These and other embodiments are discussed below with reference to the accompanying figures. However, those skilled in the art will readily appreciate that the detailed description given herein with respect to these figures is for explanatory purposes only and should not be construed as limiting.

FIG. 1 shows an exploded view of packaging 1 having a lid 10, a base box 20, and a ripcord 30. As shown, base box 20 includes first side panels 200, second side panels 202, and base panel 204, defining cavity 206 into which the product or portion thereof may be received. Lid 10 similarly includes first side panels 100, second side panels 102, and top panel 104, defining cavity 106 into which the product or portion thereof may be received. Lid 10's first side panels 100 are configured as parallel to, and external to, the base box 20's first side panels 200, respectively, in some embodiments.

Ripcord 30 may include a main portion 300, and a tab 302 extending from main portion 300. In some embodiments, tab 302 may include a bend or curve, such that it is more easily grabbed by a user when the user desires to remove ripcord 30. In some embodiments, packaging 1 may utilize the ripcord feature on a plurality of panels, e.g., on opposing first side panels of packaging 1. In some embodiments, ripcord 30 is not fixed to lid 10 (e.g., ripcord 30 may be fixed to base box 20 but not to lid 10, as shown, for example in FIG. 2 discussed below). In some embodiments, ripcord 30 is not fixed to base box 20 (e.g., ripcord 30 may be fixed to lid 10, but not to base box 20). In these ways, by configuring ripcord 30 to be unmoored to the lid or base, it differs from many existing ripcords which by their nature are fixed to both a base and lid, and the tearing of the ripcord tears a portion of both the lid and the base. Instead, the mechanical interlocking feature of the ripcord with the lid or base in a mechanical lock provides the secure closure of the packaging, but without needing to tear into both the lid and the base.

Figure 2:
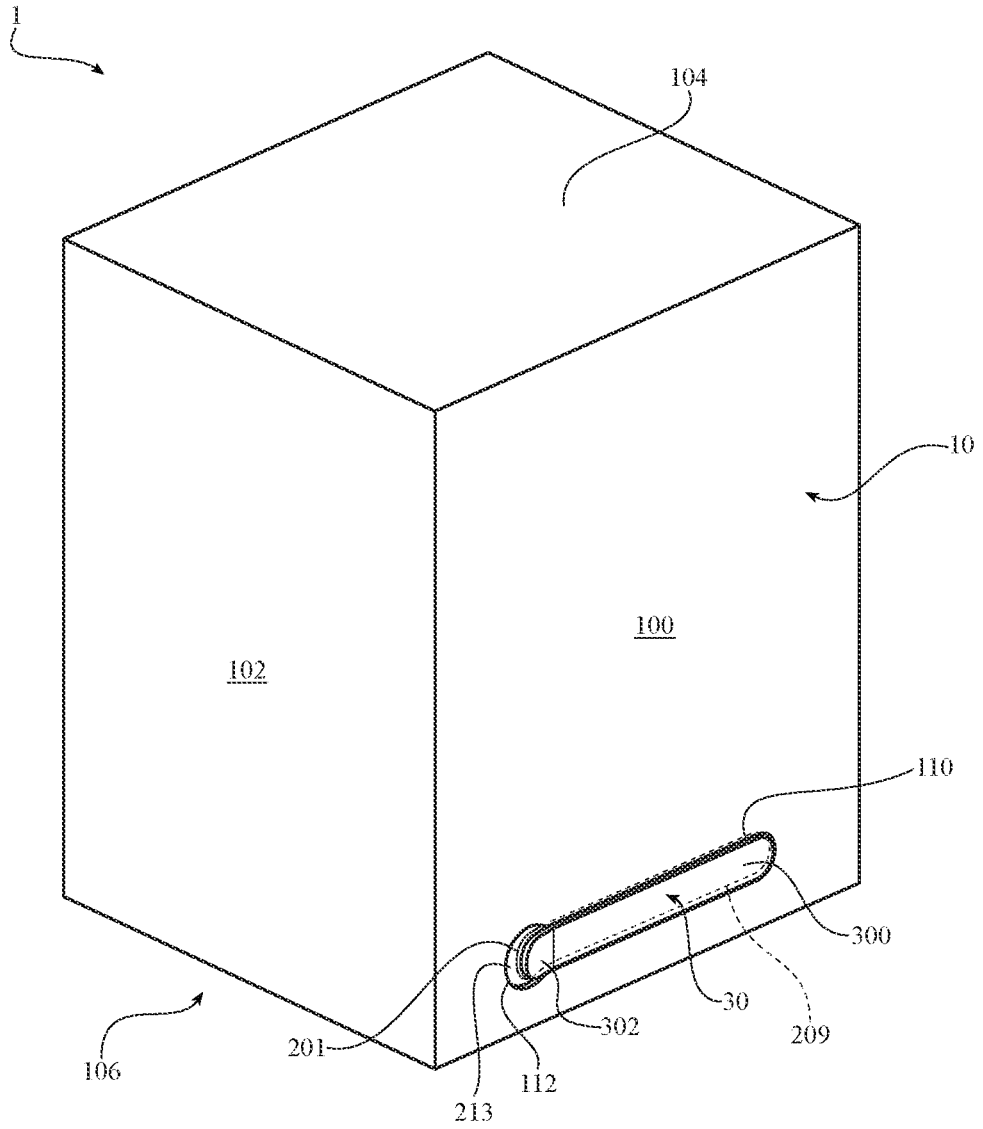
FIG. 2 shows an assembled view of the packaging shown in FIG. 1, in a closed configuration.

An assembled view of packaging 1 is shown in FIG. 2. In some embodiments, lid 10 may be lowered onto base box 20 such that a first side panel 100 of lid 10 is parallel to a first side panel 200 of base box 20, and a second side panel 102 of lid 10 is parallel to a second side panel 202 of base box 20. Additionally, in some embodiments, first side panel 100 of lid 10 is immediately adjacent to a first side panel 200 of base box 20, and a second side panel 102 of lid 10 is immediately adjacent second side panel 202 of base box 20, such that they are contacting each other such that ripcord 30 does not slip out of opening 110 due to lateral movement of the panels. In some embodiments, lid 10 is not connected to base box 20, in contrast to existing ripcord designs that may connect via flaps. In some embodiments, lid 10 entirely covers base box 20, when in a closed position, such that the lower edges of side panels 100 and 102 are flush with the plane of the base panel of base box 20.

During assembly, lid 10 may be lowered onto base box 20, and ripcord 30 may be fixed to a first side panel 200 of base box 20, for example at substrate 208. Substrate 208 is part of the base box 20, e.g., as a wrap panel as described herein. In this way, the ripcord need not tear a main portion of the base box 20, rather the wrap panel may be torn from the side panel 200, rather than tearing the entirety of the side panel 200's structure. In some embodiments, ripcord 30 is received in an opening 110 of first side panel 100. Ripcord 30 and opening 110 are configured to have a thickness that locks lid 10 and base box 20 together when in place (e.g., via interference of the edges of ripcord 30 and opening 110). In some embodiments the thickness of ripcord 30 is at least as great as the thickness of panel 100. Thickness of ripcord is at least thicker than the maximum that panel 100 can bow away from panel 200 at any point around opening 110. In some embodiments, the thickness is provided by the corrugated nature of the base box 20 and lid 10 material, e.g., as folded cardboard corrugate. For smaller packaging, grayboard structures may be used. And as described above, in some embodiments, outwardly facing surfaces of the packaging are covered in a wrap of panels of a finished cellulose-based product, while the structure of the packaging may be provided by a different material, such as cardboard corrugate for added thickness and strength. In some embodiments, the ripcord does not include plastic.

As shown in FIG. 2, for example, in some embodiments, ripcord 30 extends along a length of first side panel 100, such that it extends across at least 50% of the length of the edge of first side panel 100 defining cavity 106. In some embodiments, ripcord 30 extends along a longer length of first side panel 100, such that it extends across about 60% of the length of the edge of first side panel 100 defining cavity 106. In some embodiments, ripcord 30 extends along a longer length of first side panel 100, such that it extends across about 75% of the length of the edge of first side panel 100 defining cavity 106. In some embodiments, ripcord 30 extends along a longer length of first side panel 100, such that it extends across about 80% or more of the length of the edge of first side panel 100 defining cavity 106. In some embodiments, opening 110's length extends a complimentary distance along the length of the edge of first side panel 100, such that it closely matches the extension of ripcord 30.

When the length of the edge of the first side panel 100 increases, additional extension of ripcord 30 along first side panel 100 is advantageous to prevent bowing of first side panel 100 from being able to circumvent the ripcord 30's mechanical lock, and ensures engagement between ripcord 30 and opening 110 such that packaging 1 remains closed until ripcord 30 is removed. In some embodiments, upper and lower edges of opening 110 and upper and lower edges of ripcord 30 are closely fit together, such that lid 10 and base box 20 are not able to slide vertically relative to each other while ripcord 30 is engaged. In some embodiments, the thickness of ripcord 30 at least thicker than the maximum that panel 100 can bow away from panel 200 at any point around opening 110. In some embodiments, panel 100 is maintained in contact with panel 200 (e.g., by the fit of the boxes together).

Opening 110 may be configured as a slot as shown, and may include a further opening 112 which may include a dimension larger than a dimension of opening 110. Opening 112 allows for the user to grasp a tab 302 of ripcord 30 when in an assembled configuration. Together, they create the complete opening 108 (see FIG. 5).

In some embodiments, substrate 208 and ripcord 30 may be connected via adhesive, such as a pressure sensitive adhesive, fiber tape, splitable adhesive, peelable adhesive, etc. To install ripcord 30, an adhesive portion 211 attaching ripcord 30 to base box 20 may be exposed and fixed to the first side panel 202, and lid 10 lowered onto base box 20. Before lid 10 is lowered onto base box 20, the adhesive portion attaching ripcord 30 to base box 20 may be unexposed (e.g., a tape backing may be present so that it does not unintentionally stick to an unwanted surface). After the lid 10 and base box 20 are closed, the backing may be removed (e.g., by having an extended tab of backing protruding from the closed packaging), and ripcord 30 may be pressed toward first side panel 202 at substrate 208, thereby fixing ripcord 30 to base box 20. Alternatively adhesive may be placed on ripcord 30 itself, first, and then ripcord 30 is fixed to the panel through opening 110.

In this way, ripcord 30 and base box 20 are effectively coupled and fixed together in a closed configuration. Substrate 208 terminates in a tab 201 which is accessible from a cut-out 212, and may include tear paths such as perforations 209 that aid in tearing substrate 208 away from first side panel 200 during removal of ripcord 30. Surface 213 is visible, which may be part of an additional wrap panel as described with reference to FIGS. 6 and 9, below. In some embodiments, score lines, thin layers, or other features designed to allow easy and/or guided tearing of substrate 208 may be provided.

Figure 3:
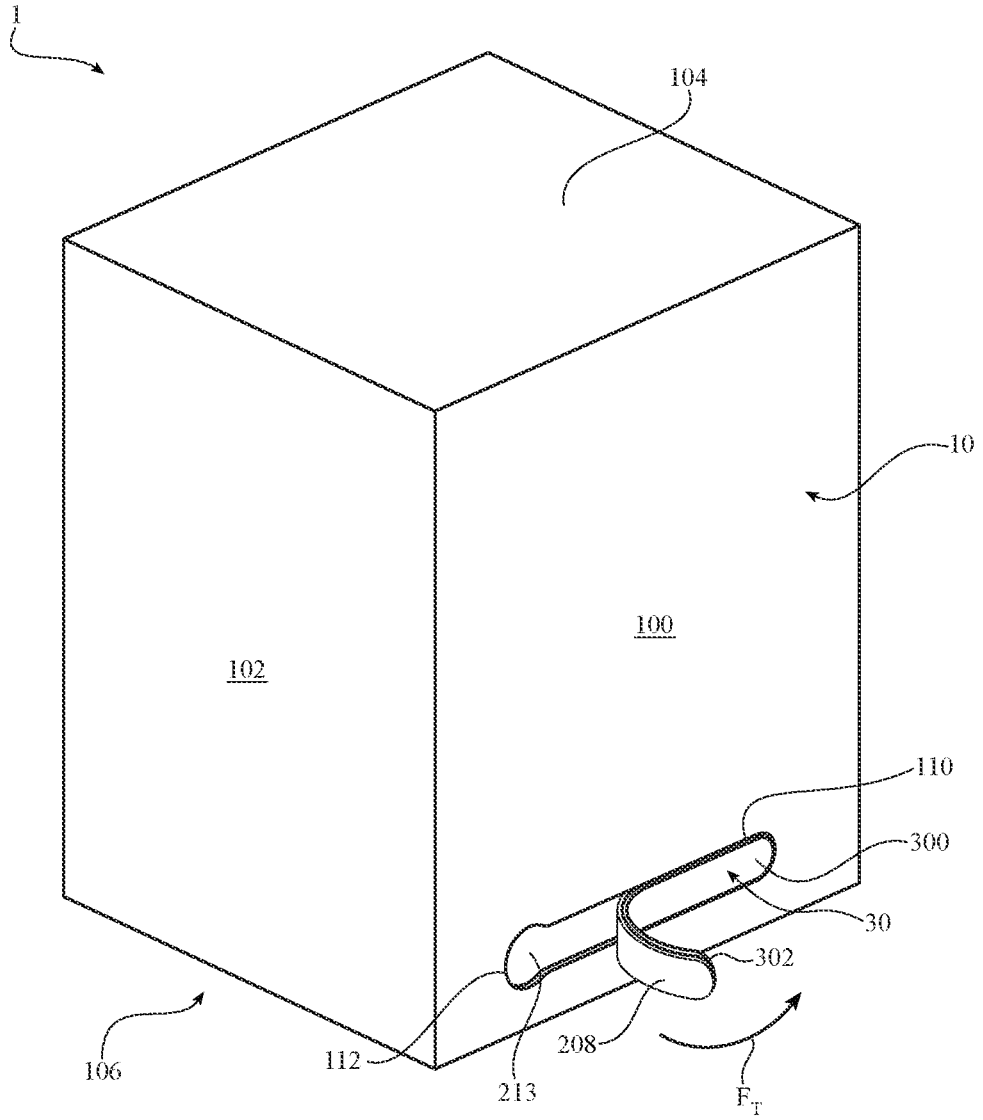
FIG. 3 shows the packaging shown in FIGS. 1 and 2, showing partial removal of a ripcord.
Figure 4:
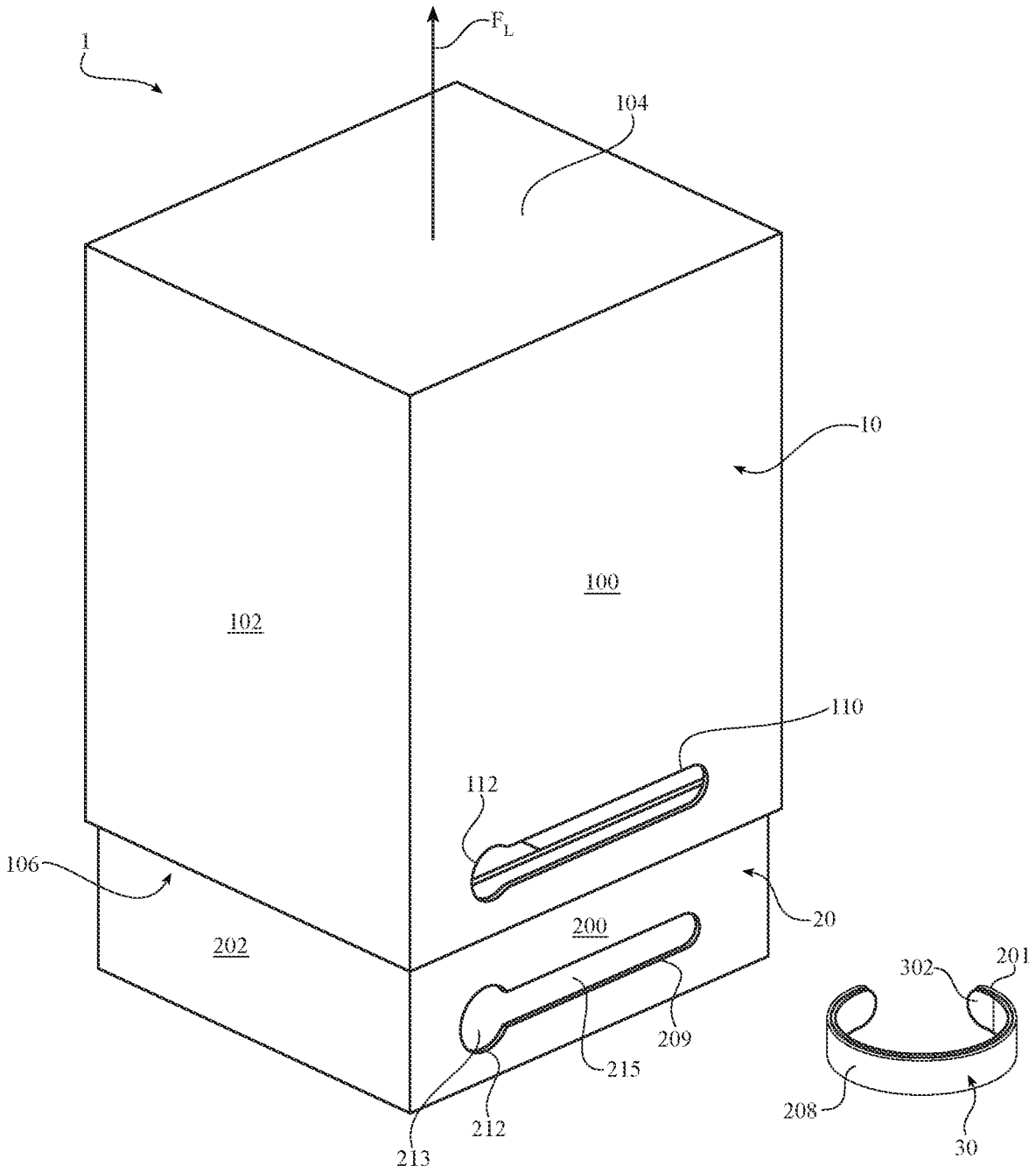
FIG. 4 shows the packaging shown in FIGS. 1-3, with the ripcord removed, and the upper lid being lifted off the base box.

Turning to FIGS. 3 and 4, when tab 302 (coupled to tab 201) is pulled with sufficient force, it is removable such that the mechanical lock is released so that the packaging may be opened. For example, when force $F_T$ is applied, the edges of substrate 208 tear while its outer surface remains fixed to ripcord 30. In this way, while ripcord 30 is coupled to base box 20 base box 20 and lid 10 are coupled, via the locking effect of ripcord 30 within opening 110. After a user detaches ripcord 30 by pulling, for example tab 302 with sufficient force such that substrate 208 tears along perforations 209 ripcord 30 no longer connects base box 20 and lid 10, and packaging 1 may be opened. Due to the destructive nature of the tearing of substrate 208, ripcord 30 may not be reattached to base box 20. Surface 215 is then visible, which extends from surface 213 underneath where substrate 208 was previously, and provides a finished look of base box 20 even after ripcord 30 no longer connects base box 20 and lid 10. By fixing substrate 208 to ripcord 30, rather than having ripcord 30 be a part of base box 20's corrugated structure, the sufficient force $F_T$ may generally be lower than if a user had to tear the entirety of the material thickness of ripcord 30. So in contrast to large corrugated shipping boxes, that may include a corrugated tear strip, packaging 1 improves upon such designs by retaining a structurally sound corrugated ripcord 30, while improving the user experience when ripcord 30 is removed, since only substrate 208 need be torn.

Once ripcord 30 is removed (see FIG. 4), the user may lift lid 10 off of base box 20 using force $F_L$.

In some embodiments, substrate 208 does not tear, but may peel away in the case of using splittable or peelable adhesive. This achieves a similar locking function, when ripcord 30 is coupled to base box 20, but avoids requiring a tearing of a component. In those cases, in response to a force applied in a direction away from the packaging (e.g., in a removal direction, at tab 302), one or more of the adhesives are configured to peel away such that substrate 208 does not tear. As a mechanism of tamper-evidence, the adhesives may be configured such that they may not be able to be used or reapplied once ripcord 30 is removed, e.g., by exposing a non-adhesive surface, or simply leaving the adhesive surface attached to the packaging during removal of ripcord 30.

In general, for adhesives that are intended to peel off (e.g., removable adhesives), they peel away at an applied force on the ripcord 30 (e.g., at tab 302) that is less than that which would tear the substrate (e.g., tear strength of the substrate). In contrast, for adhesives that are not intended to peel off (e.g., permanent adhesives) the force required to remove them is greater than the force at which the substrate will tear. And in generally, once a splittable adhesive is in fact split, the newly-exposed inner surfaces, formerly interior to the splittable adhesive between its outer surfaces, do not re-adhere. In some embodiments of the splittable adhesive, once split the formerly interior surface does not stick to other components. In embodiments utilizing splittable adhesive, the splittable adhesive may provide the similar function to tearing of other embodiments, that is, the splitting of the adhesive layers decouples the ripcord 30 such that the package 1 may be opened.

Once packaging 1 is opened, the user may retrieve the product and any accessories from within packaging 1. And when ready, the packaging may recycled, e.g., in a single-stream system, without worry of thin-film plastic wraps, or polymer ripcords.

Figure 5:
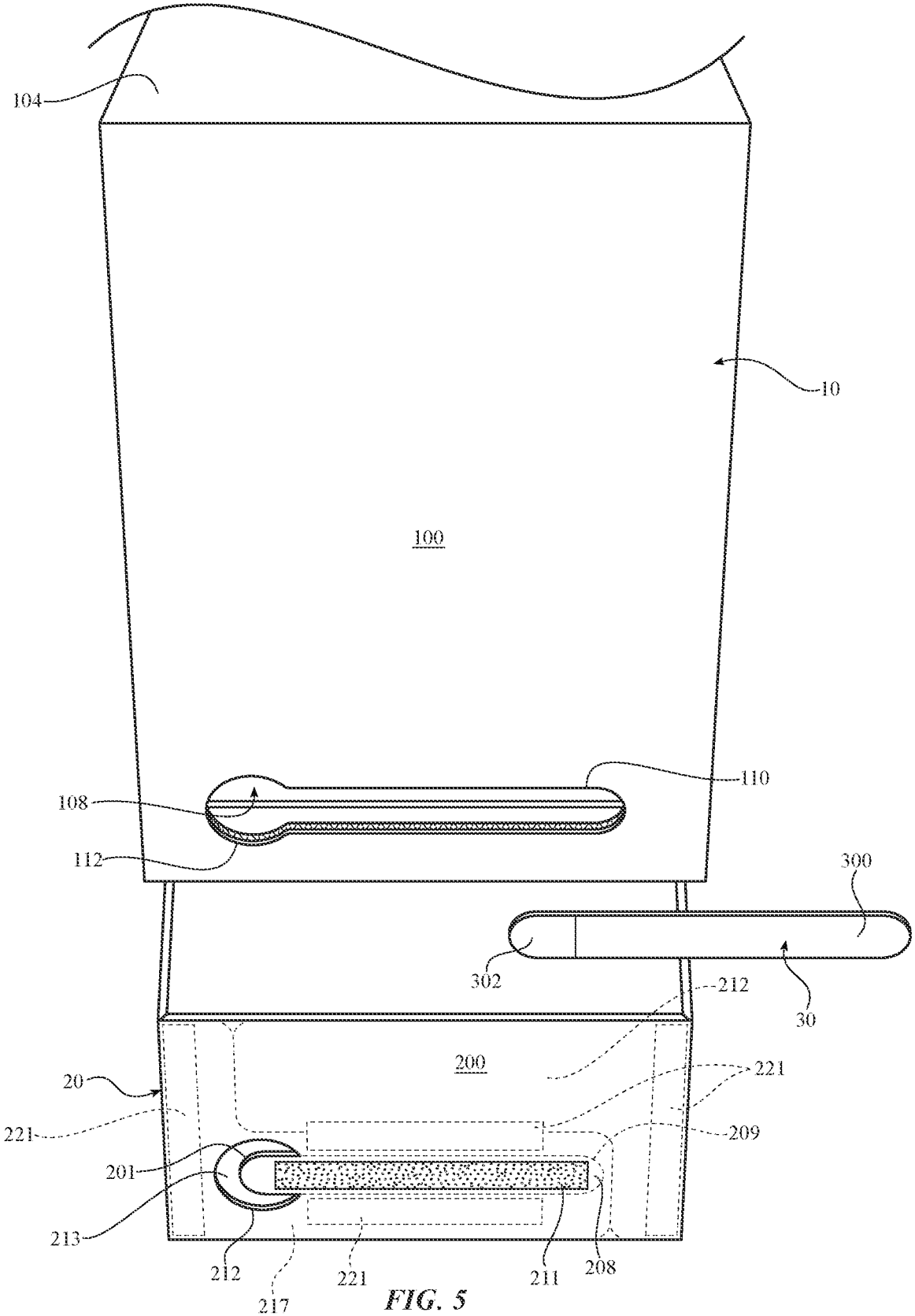
FIG. 5 shows the packaging shown in FIGS. 1-4, in a pre-assembled state, in an embodiment.
Figure 6:
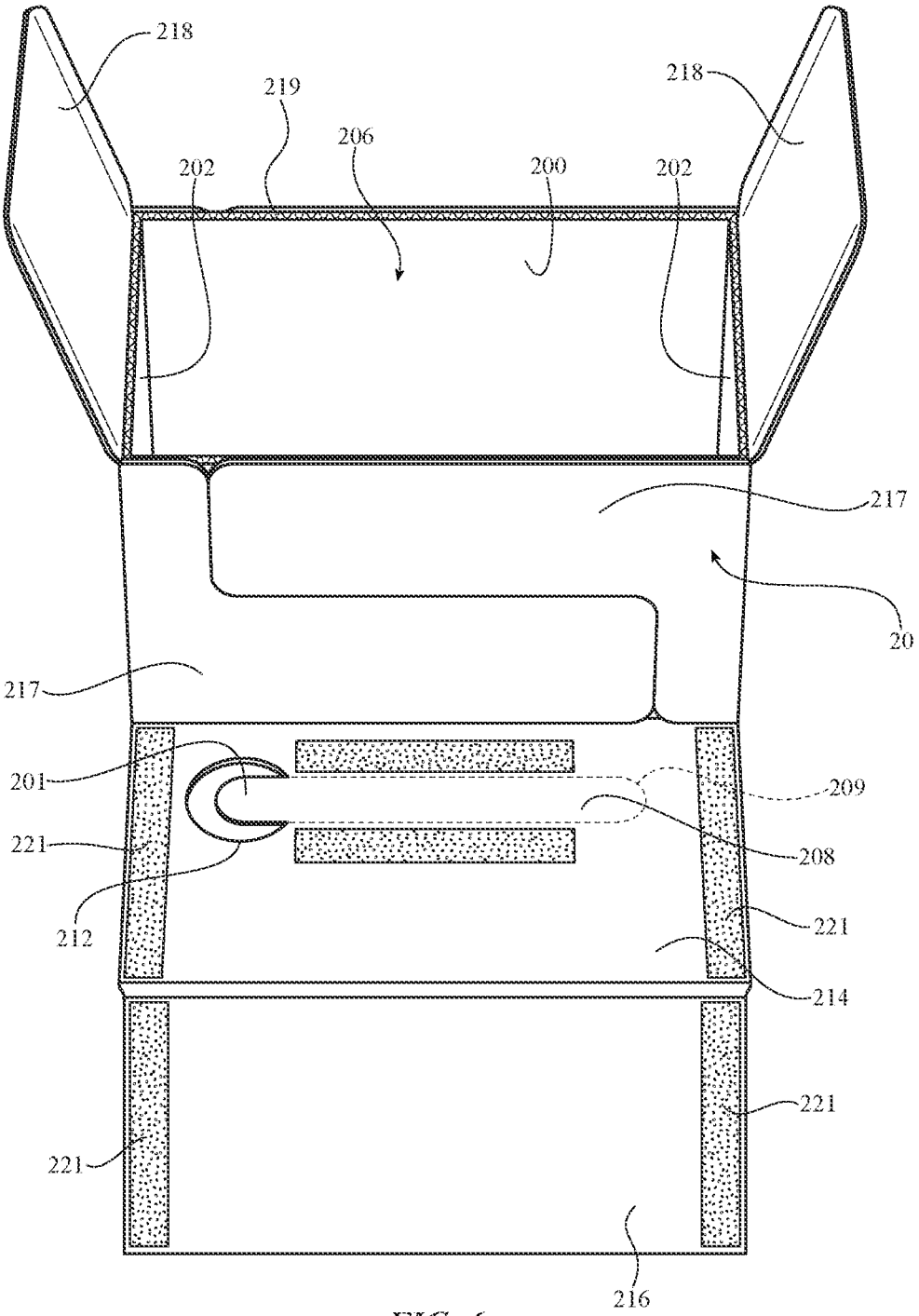
FIG. 6 shows the packaging shown in FIGS. 1-5, in a pre-assembled state, in an embodiment.

Turning to FIGS. 5 and 6, the material structure of packaging 1 is further shown. As described above, lid 10, base box 20, and ripcord 30 may include a cardboard corrugate (e.g., E-flute or F-flute) structure, and be folded into shape. The corrugate gives structural support and thickness for engagement of the interlocking ripcord mechanical lock. And, in some embodiments, outwardly facing surfaces of the packaging may be covered in a wrap of panels of a finished cellulose-based product (e.g., paperboard such as solid bleached sulfate "SBS"). Such a wrap is shown in FIG. 6 as partially removed.

The wrap panels may be formed from a blank and folded around the corrugate panels, thereby hiding the corrugate panels and having a more polished and finished outward appearance. Adhesive portions 221 may be provided to adhere the respective panels to other panels, or to the corrugate panels of packaging 1. As an example, interior wrap panels 218 may be folded inward, and cover a portion of second side panels 202, for example. In some embodiments, secondary panels 217 are provided, and may be L-shaped. In this way, secondary panel 217 provides surfaces 213 and 215 when ripcord 30 is eventually removed, and provides the same polished and finished appearance (without showing a seam of the secondary panels 217 meeting, and without showing the material disposed beneath, e.g., the cardboard corrugate).

In some embodiments, exterior wrap panel 214 is folded upward during assembly and adhered to secondary panels 217 at adhesive portions 221. As shown in FIG. 6 for example, substrate 208 remains unfixed to a secondary panel such that it may be torn away along tear lines 209 when packaging 1 is eventually opened. In some embodiments, interior panel 216 then folds inward during assembly, and covers an interior portion of first wall 200. Similar wrap panels are provided for both of lid 10 and base box 20, as shown in the blanks illustrated in FIGS. 7-10.

Figure 7:
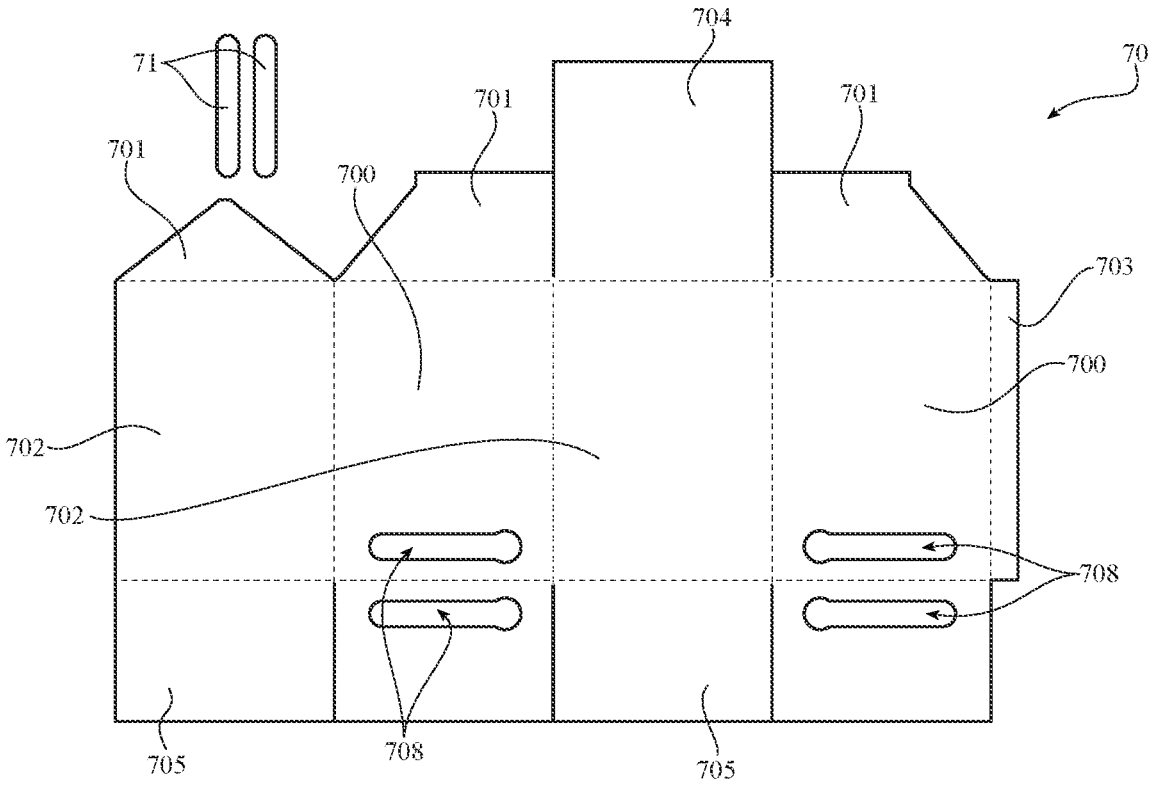
FIG. 7 shows a blank for covering a lid, in an embodiment.

In FIGS. 7-10, broken lines show the boundaries of the respective portions, and denote where the folds will be. FIG. 7 shows a blank 70 for covering lid 10. Blank 70 may be formed from several wrap panels, of a finished cellulose-based product (e.g., paperboard such as solid bleached sulfate "SBS") as described above in some embodiments. Ripcord wrap panels 71, for example maybe secured to either side of ripcord 30, to provide a polished finished appearance. As shown, first wrap panel 700 may correspond to first side panels 100, and second side panels 102 may correspond to second wrap panels 702. In some embodiments, cut-outs 708 correspond to openings 108. In some embodiments, top wrap panel 704 corresponds to the top panel 104, and auxiliary panel 701 may similarly be folded inward to secure blank 70 and covering lid 10. Connection panel 703 may fix the outermost first and second side wrap panel 700/702.

Figure 8:
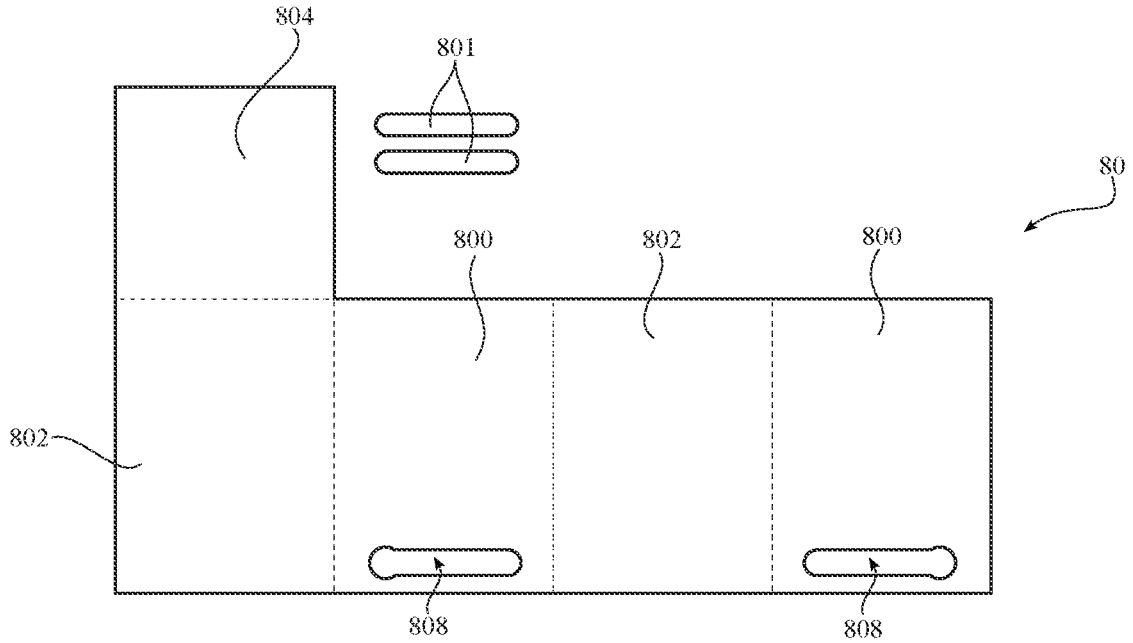
FIG. 8 shows a blank for forming a lid, in an embodiment.

FIG. 8 shows a blank 80 for forming lid 10. Blank 80 may be formed from several panels, of cardboard corrugate (e.g., E-flute, F-flute, etc.). Ripcord blanks 801, provide the structure that ripcord wrap panels 71 are secured to either side of. As shown, first panel 800 may correspond to first side panels 100, and second side panels 102 may correspond to second panels 802. In some embodiments, cut-outs 808 correspond to openings 108. In some embodiments, top panel 804 corresponds to the top panel 104.

Figure 9:
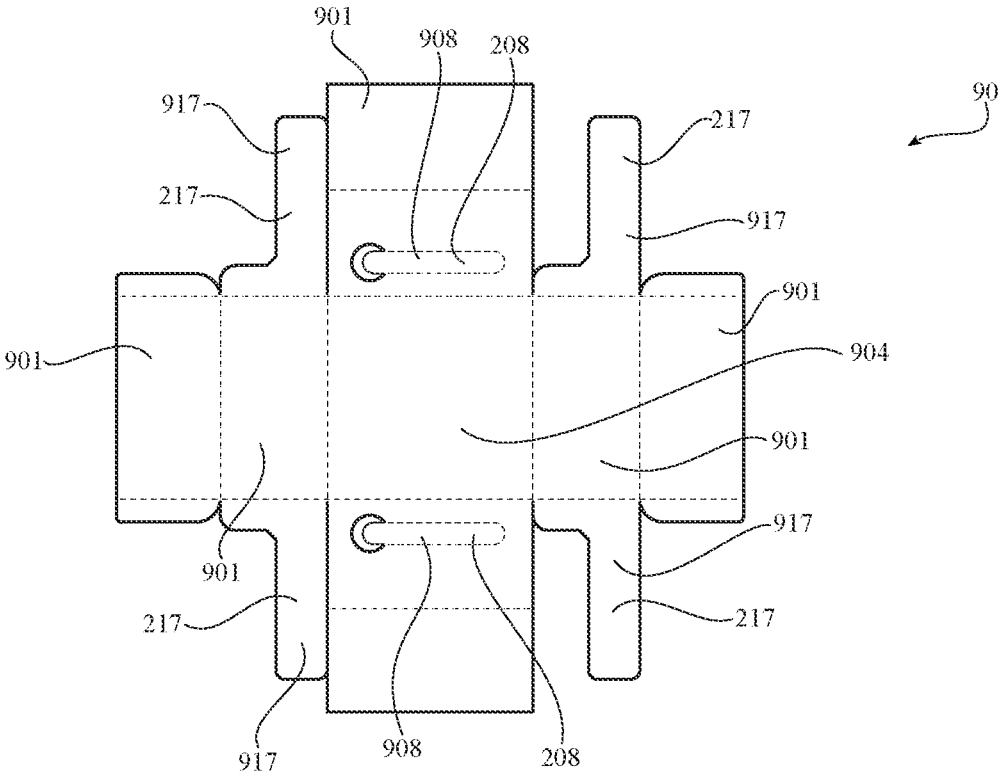
FIG. 9 shows a blank for covering a base box, in an embodiment.

FIG. 9 shows a blank 90 for covering base box 20. Blank 90 may be formed from several wrap panels, of a finished cellulose-based product (e.g., paperboard such as solid bleached sulfate "SBS") as described above in some embodiments. As shown, side wrap panels 901 fold upward and are configured to fold over first and second side panels 200/202 of base box 20. May correspond to first side panels 100, and second side panels 102 may correspond to second wrap panels 702. Panel 908, may take the form of substrate 208 once in an assembled configuration. In some embodiments, secondary panels 917 are provided, and are configured to be secondary panels 217 when assembled. Secondary panels are L-shaped, in some embodiments.

Figure 10:
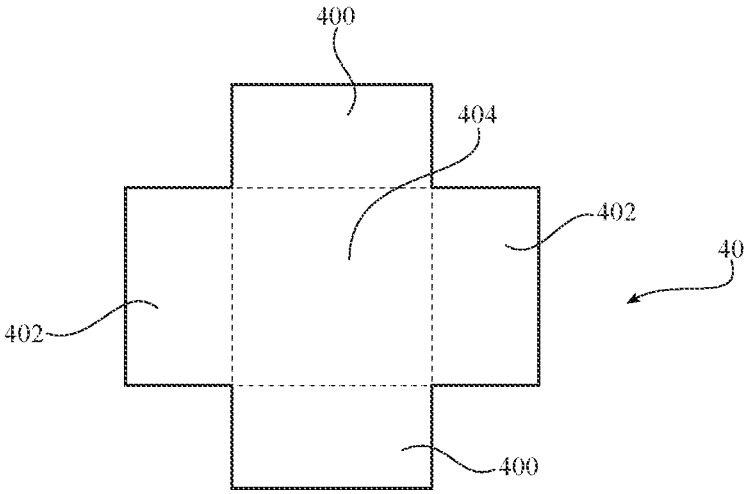
FIG. 10 shows a blank for forming a base box, in an embodiment.

FIG. 10 shows a blank 40 for forming base box 20. Blank 40 may be formed from several panels of cardboard corrugate (e.g., E-flute, F-flute, etc.). As shown, first panels 400 may correspond to first side panels 200, and second side panels 202 may correspond to second wrap panels 402. In some embodiments, panel 404 corresponds to base panel 204.

Tabs, flaps, and regions without adhesive of the blank are folded such that no adhesive is visible in finished packaging. In some embodiments, adhesive may be omitted and the various flaps and tabs attached in another suitable manner (e.g., by mechanical interlock or press fit).

Each of the components and their constituent parts, and other variations described herein may include corresponding features described with reference to each of the other components and features described without limitation.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Packaging, comprising:

a base box;

a lid; and a ripcord configured to mechanically lock the base box and the lid such that the base box and the lid are secured together in a closed configuration, wherein the ripcord is not fixed to the lid, and wherein when the ripcord is pulled with sufficient force, it is removable such that the mechanical lock is released so that the packaging may be opened.

2. The packaging of claim 1, wherein the base box comprises a substrate that the ripcord is fixed to, such that the substrate tears when the ripcord is pulled with sufficient force, thereby releasing the mechanical lock.

3. The packaging of claim 2, wherein the substrate comprises a wrap panel that covers a cardboard corrugate panel of the base box.

4. The packaging of claim 2, wherein the substrate is configured to tear along tear paths extending along the direction of the pull force.

5. Packaging, comprising:

a base box comprising a first side panel;

a lid comprising:

a first side panel parallel to, and external to, the base box's first side panel; and a slot formed in the lid's first side panel; and a ripcord disposed within the slot and fixed to the base box when the packaging is in a closed configuration, such that the base box and lid are secured together in a closed configuration.

6. The packaging of claim 5, wherein the lid comprises cardboard corrugate having a thickness, and wherein the ripcord comprises cardboard corrugate having a thickness, such that the respective edges of the slot and the edges of the ripcord interfere with each other, thereby retaining the lid in place relative to the base box until the ripcord is removed from the packaging.

7. The packaging of claim 5, wherein the ripcord is attached to a substrate formed on the base box's first side panel such that in response to a sufficient force applied along a tearing direction of the ripcord, the substrate tears away from the base box but remains fixed to the ripcord, thereby releasing the lid and base box.

8. The packaging of claim 5, wherein the ripcord is attached to the base box via a splittable adhesive, such that in response to a sufficient force applied along a removal direction of the ripcord, the splittable adhesive splits such that the ripcord is removed, thereby releasing the lid and base box.

9. The packaging of claim 5, wherein the substrate is part of a wrap panel and is not fixed to the base box's first side panel.

10. The packaging of claim 5, wherein the ripcord further comprises a tab configured to allow a user to grasp the ripcord, and wherein the substrate terminates in a tab that connects to the tab of the ripcord, and is accessible via a cutout along the base box's first side panel.

11. The packaging of claim 5, wherein the ripcord does not include plastic.

12. The packaging of claim 5, wherein a length of the slot is longer than a length of the ripcord, along a removal direction of the ripcord.

13. The packaging of claim 5, wherein the ripcord extends between 50% and 85% of the length of the base box's first side panel, along a removal direction of the ripcord.

14. Packaging, comprising:

a base box comprising:

a first side panel comprising a first material;

a first wrap panel covering an outwardly facing surface of the first side panel and comprising a second material;

a lid comprising:

a first side panel parallel to, and external to, the base box's first side panel, and comprising the first material; and a first wrap panel covering an outwardly facing surface of the first side panel and comprising the second material, wherein a slot is disposed in the lid's first side panel and first wrap panel; and a ripcord disposed within the slot and fixed to the base box's first wrap panel when the packaging is in a closed configuration, such that the base box and lid are secured together via a mechanical lock formed from the ripcord and slot, together, in a closed configuration.

15. The packaging of claim 14, wherein when the ripcord is pulled with sufficient force, a portion of the base box's first wrap panel tears away with the ripcord, thereby allowing the ripcord to be removed from the slot, and releasing the mechanical lock.

16. The packaging of claim 15, further comprising:

a secondary panel comprising the second material and disposed beneath the base box's first wrap panel, such that when the ripcord is removed, the first material is not visible to a user.

17. The packaging of claim 16, wherein the first material is cardboard corrugate, and the second material is not cardboard corrugate.

18. The packaging of claim 14, wherein the first material is cardboard corrugate, and the second material is not cardboard corrugate.

19. The packaging of claim 14, wherein first material has a thickness, and wherein the ripcord comprises the first material, such that the thickness of the slot and the thickness of the ripcord interfere with each other, thereby forming the interlocking mechanical lock until the ripcord is removed from the packaging.

20. The packaging of claim 19, wherein the ripcord further comprises ripcord wrap panels comprising the second material, and wherein the first material is cardboard corrugate, and the second material is not cardboard corrugate.

* * * * *